US009637141B2

(12) United States Patent
Swenson

(10) Patent No.: US 9,637,141 B2
(45) Date of Patent: May 2, 2017

(54) LOCOMOTIVE SYSTEM

(71) Applicant: Electro-Motive Diesel, Inc., LaGrange, IL (US)

(72) Inventor: Scott A. Swenson, Willowbrook, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 379 days.

(21) Appl. No.: 13/692,524

(22) Filed: Dec. 3, 2012

(65) Prior Publication Data

US 2014/0150686 A1 Jun. 5, 2014

(51) Int. Cl.
*B61C 17/02* (2006.01)
*B61C 5/00* (2006.01)

(52) U.S. Cl.
CPC ..... *B61C 17/02* (2013.01); *B61C 5/00* (2013.01); *Y10T 29/49817* (2015.01); *Y10T 29/49826* (2015.01)

(58) Field of Classification Search
CPC ..... B61C 5/00–5/04; B61C 17/02
USPC ..... 280/834
See application file for complete search history.

(56) References Cited

U.S. PATENT DOCUMENTS 5,129,328 A * 7/1992 Donnelly ..... B61O 5/00 105/26.05
5,197,443 A * 3/1993 Hodgkins ..... B60K 15/077 123/510
5,566,712 A * 10/1996 White ..... B61O 5/00 137/587
5,636,654 A 6/1997 Helm
6,378,823 B1 * 4/2002 Edholm ..... B60K 15/067 180/68.5
6,494,226 B2 * 12/2002 Tipton ..... B60K 15/00 123/514
6,550,811 B1 * 4/2003 Bennett ..... B60K 15/03 180/314
7,681,556 B2 * 3/2010 Hwang ..... E02F 9/00 123/510
8,882,071 B2 * 11/2014 Green ..... B60K 15/067 123/575
9,145,052 B2 * 9/2015 De Biasi ..... B60K 15/067
2006/0144284 A1 * 7/2006 Martini ..... B61C 3/00 105/35
2011/0067390 A1 * 3/2011 Cook ..... B61C 17/02 60/320
2012/0085260 A1 4/2012 Nichini et al.
2013/0001364 A1 * 1/2013 Cardell ..... B64C 39/024 244/135 R (Continued)

FOREIGN PATENT DOCUMENTS

DE 19619933 11/1997
GB 143816 5/1920
WO 2011068443 6/2011

*Primary Examiner* — Zachary Kuhfuss
(74) *Attorney, Agent, or Firm* — Finnegan, Henderson, Farabow, Garrett & Dunner, LLP

(57) ABSTRACT

A fuel tank is configured to be selectively coupled to a chassis of the locomotive based on an anticipated change in axle load capacity of a railroad. The fuel tank includes a body, a coupling device, and a lifting adapter. The coupling device is configured to releasably couple the body to the chassis of the locomotive. The lifting adapter is configured to releasably engage with a lifting implement of a machine.

26 Claims, 5 Drawing Sheets

(56) References Cited

U.S. PATENT DOCUMENTS

| | | | | |
|---|---|---|---|---|
| 2013/0152815 | A1* | 6/2013 | Kanda | B60L 11/08 105/35 |
| 2013/0239845 | A1* | 9/2013 | Frazier | B61C 3/00 105/27 |
| 2014/0048541 | A1* | 2/2014 | Pirtle | B60K 15/03 220/562 |
| 2014/0261073 | A1* | 9/2014 | Cook | F01N 3/20 105/392.5 |
| 2014/0290526 | A1* | 10/2014 | Steindorff | B60K 15/03 105/26.05 |
| 2015/0291133 | A1* | 10/2015 | Hidalgo Balboa | B60K 15/03 414/573 |

* cited by examiner

LOCOMOTIVE SYSTEM

TECHNICAL FIELD

The present disclosure relates to a locomotive system, and more particularly to a locomotive system configured to run on railroads of varying axle load capacities.

BACKGROUND

Axle load capacities of railroads vary from one railroad to another. A first railroad may be able to withstand a heavy axle load of a locomotive while a second railroad may be able to withstand a lighter axle load as compared to the first railroad. However, each axle of a locomotive may need to conform to the axle load capacity requirements of the railroad at all instants of time.

Typically, industrial locomotives may be used to pull cargo containers. Conventional methods of complying cargo containers with two or more railroads of different axle load capacities may typically involve transferring contents from larger cargo containers to smaller containers or vice-versa so that individual axle loads associated with each container may comply with the new axle load capacity of the onward railroad. However, an axle load on each axle of the locomotive may still remain unchanged and hence be non-compliant with the axle load capacity of the railroad. Hence, an overall weight of the locomotive may also need to be modified in order to make the individual axles of the locomotive compliant with the varying axle load capacities of the railroad.

U.S. application Ser. No. 12/899,670 relates to an improved rail system fuel tender for use with one or more railroad locomotives capable of transporting a plurality of fuel containers. The fuel containers are suitable for containing pressurized fuel and directly fueling the one or more locomotives. The improved fuel tender may be powered by the locomotives to increase tractive effort, and the fuel containers may be separately fillable and separately removable from the fuel tender.

SUMMARY

In one aspect, the present disclosure provides a locomotive system configured to run on a railroad. The locomotive system includes two or more axles, a chassis disposed on the axles, an engine connected to the chassis, a first fuel tank, and a second fuel tank. The first fuel tank is configured to supply fuel to the engine. The second fuel tank is configured to be selectively coupled to the chassis. The second fuel tank is further configured to selectively exchange fuel with the first fuel tank.

In another aspect, the present disclosure provides a locomotive system configured to run on a railroad. The locomotive system includes two or more axles, a chassis disposed on the axles, an engine connected to the chassis, a first fuel tank, and a second fuel tank. The first fuel tank is configured to supply fuel to the engine and impose a first laden weight on the axles. The second fuel tank is configured to be selectively coupled to the chassis and selectively exchange fuel with the first fuel tank. The second fuel tank has a second laden weight imposed on the axles such that an axle load on each of the axles lies between a maximum and minimum axle load capacity of the railroad.

In another aspect, the present disclosure provides a method of regulating an axle load on an axle of a locomotive. The method includes providing a first laden weight of a first fuel tank to the axle. The method includes selectively providing a second laden weight of a second fuel tank to the axle such that the axle load on the axle defined together by the first and the second laden weights lies between a maximum and minimum axle load capacity of the railroad.

Other features and aspects of this disclosure will be apparent from the following description and the accompanying drawings.

DETAILED DESCRIPTION

Figure 1:
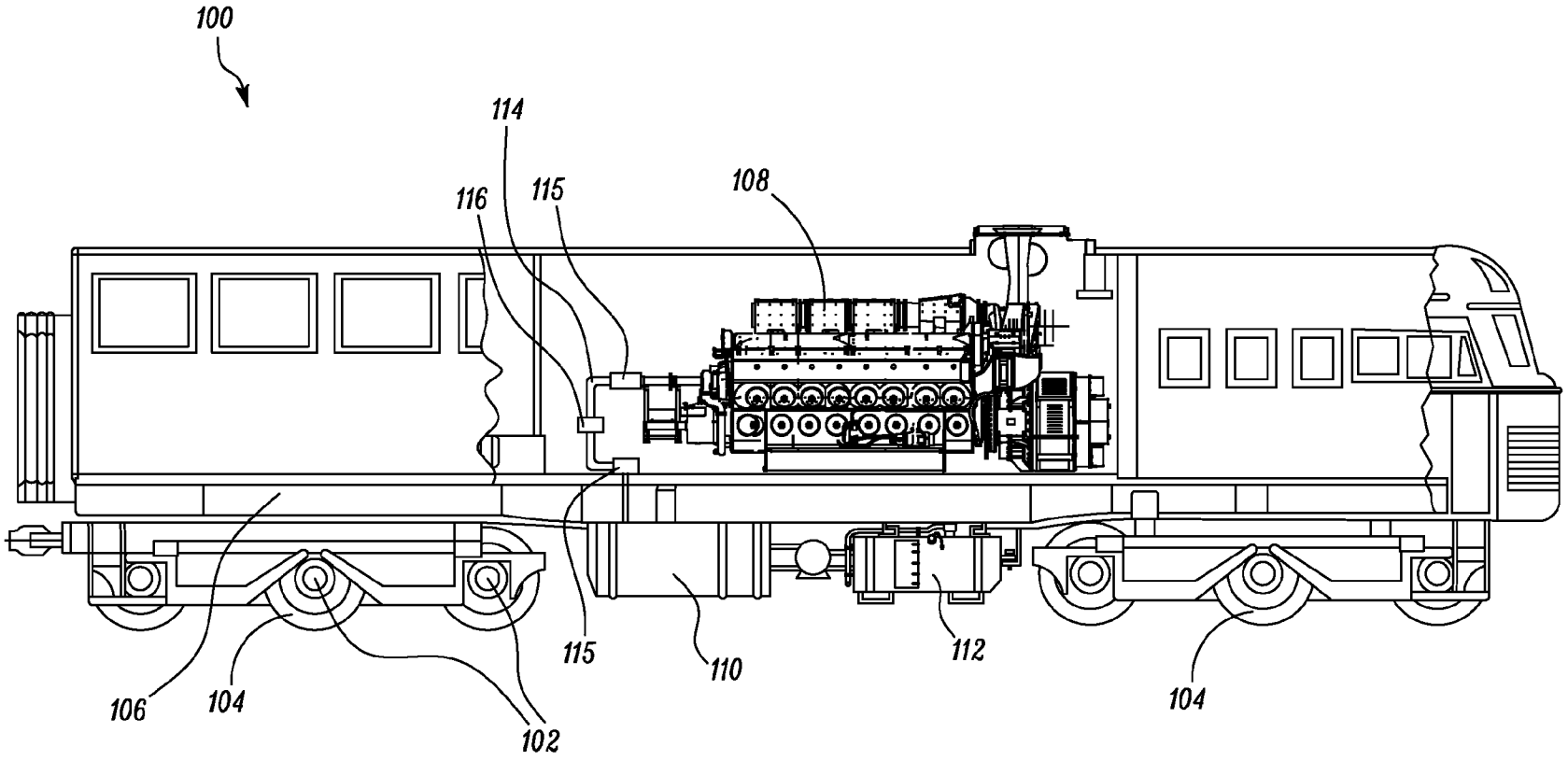
FIG. 1 is a side view of a locomotive system in accordance with an embodiment of the present disclosure.

The present disclosure relates to a locomotive system configured to run on railroads of varying axle load capacities. FIG. 1 shows a side view of the locomotive system 100 in which disclosed embodiments may be implemented. In an embodiment, the locomotive system 100 may be an industrial locomotive configured to pull cargo containers (not shown). In another embodiment, the locomotive system 100 may be a commercial locomotive configured to pull passenger cars (not shown).

The locomotive system 100 includes two or more axles 102. In an embodiment as shown in FIG. 1, the locomotive system 100 may include six axles 102 associated with wheels 104. The locomotive system 100 may further include a chassis 106, an engine 108, a first fuel tank 110 and a second fuel tank 112. The chassis 106 is disposed on the axles 102.

Figure 2:
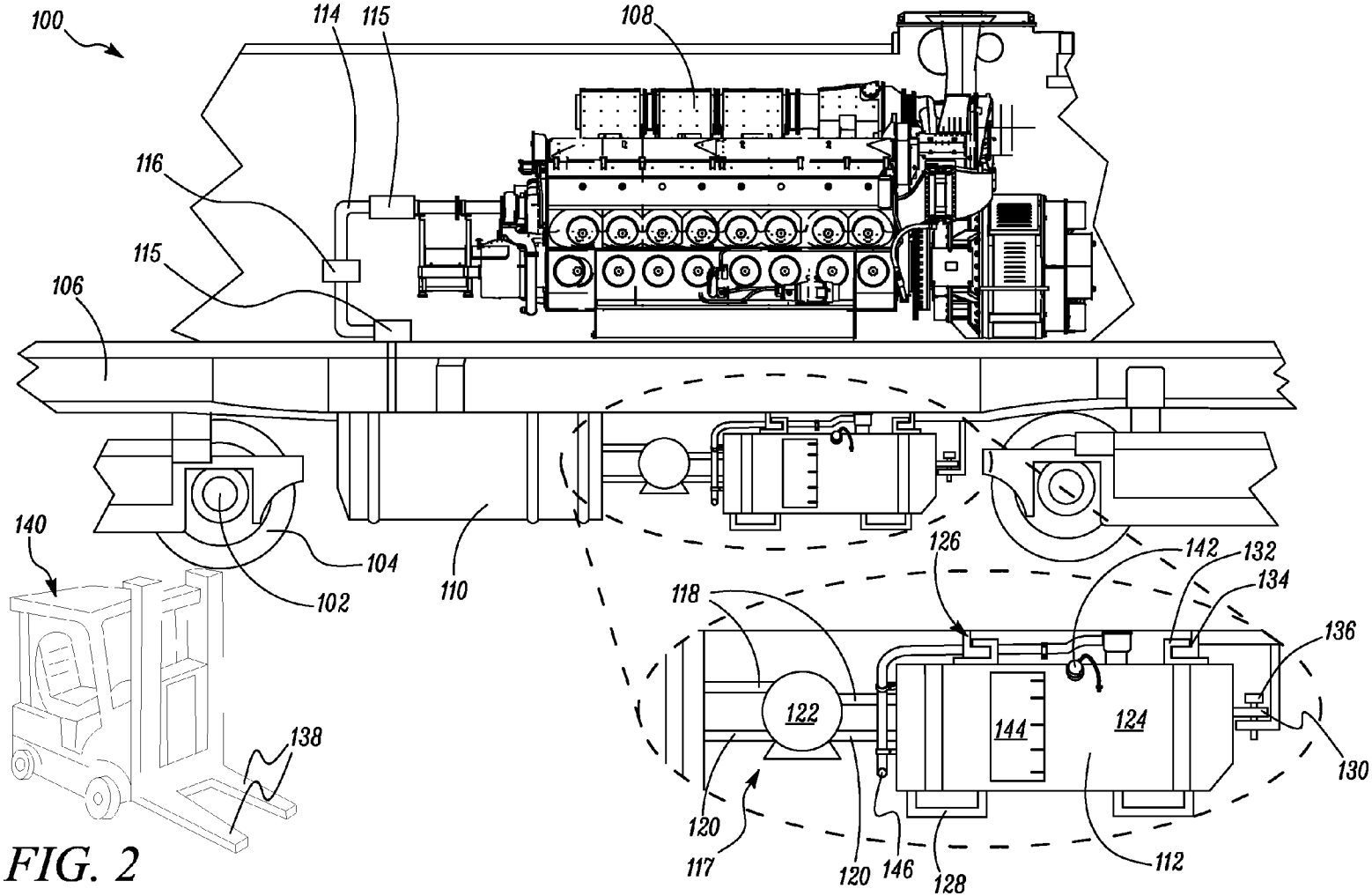
FIG. 2 is a breakaway side view of the locomotive system showing a first fuel tank and a second fuel tank.

As shown in FIG. 2, the engine 108 is connected to the chassis 106. The engine 108 may be of any type. In one embodiment, the engine 108 may be a gas turbine engine 108, which may be used to drive a generator for power generation. In other embodiments, the engine 108 may be a reciprocating engine, such as a diesel engine. In one embodiment, the engine 108 may use a fuel such as natural gas or synthesis gas (syngas).

The first fuel tank 110 is configured to supply fuel to the engine 108. The first fuel tank 110 may be fluidly connected to the engine 108 via an inlet line 114. In an embodiment, one or more filters 115 and a pump 116 may be disposed in the inlet line 114. The filters 115 may remove any impurities such as dirt or dust particles present in the fuel while the pump 116 may suck, pressurize, and deliver the fuel to injectors (not shown) of the engine 108.

The second fuel tank 112 is configured to be selectively coupled to the chassis 106 and selectively exchange fuel with the first fuel tank 110. In an embodiment as shown in FIG. 2, the locomotive system 100 may further include a transfer system 117 including a supply line 118, a return line 120, and a pump 122. The supply line 118 and the return line 120 may be operatively connected to the first fuel tank 110 and the second fuel tank 112. The pump 122 may be configured to selectively transfer fuel from one of the second fuel tank 112 to the first fuel tank 110 and the first fuel tank 110 to the second fuel tank 112 via the supply line 118 and the return line 120 respectively.

In an embodiment as shown in FIG. 2, the second fuel tank 112 may include a body 124, a coupling device 126, and a lifting adapter 128. The coupling device 126 may be configured to releasably couple the body 124 to the chassis 106. In one embodiment as shown in FIG. 2, the coupling device 126 may include straight tabs 130 extending away from the body 124 of the second fuel tank 112. In another embodiment as shown in FIG. 2, the coupling device 126 may include angled tabs 132 extending from the body 124 of the second fuel tank 112. In the preceding embodiments, the angled tabs 130, 132 may be configured to slidably engage with a corresponding sliding groove 134 disposed on the chassis 106. Further, the coupling device 126 may include a pin configured to secure the straight tabs 132 to the sliding groove 134 of the chassis 106. Although in the preceding embodiments, it is disclosed that the coupling device 126 may be straight/angles tabs used in conjunction with the pin, a person having ordinary skill in the art may acknowledge that the coupling device 126 may be of any configuration commonly known in the art. Therefore, it is to be understood that the aforementioned configurations of the coupling device 126 are merely exemplary in nature and hence, non-limiting of this disclosure.

In an embodiment, the lifting adapters 128 may be rigidly connected to the body 124. The lifting adapters 128 may be configured to releasably engage with a lifting implement of a machine. In an embodiment as shown in FIG. 2, the lifting adapters 128 may be square hollow tubes to releasably engage with forks 138 of a forklift 140. Although in the preceding embodiment, it is disclosed that the lifting adapters 128 may be square hollow tubes, it is to be noted that, any shape of lifting adapters 128 commonly known in the art, may be used to accomplish the releasable engagement of the lifting adapters 128 to the lifting implement.

In an embodiment as shown in FIG. 2, the second fuel tank 112 may include a fill port 142, a fuel level indicator 144, and a breather tube 146. The fill port 142 may be disposed on the body 124 and configured to allow refilling of fuel into the second fuel tank 112. The fuel level indicator 144 may be configured to indicate a fill level of the fuel in the second fuel tank 112. In an embodiment as shown in FIG. 2, the fuel level indicator 144 may be of an analogue type, such as a sight glass. In another embodiment, the fuel level indicator 144 may be of a digital type, such as a digital read out device communicating with a float disposed within the body 124 of the second fuel tank 112. The breather tube 146 may be configured to allow equalization of fluid pressure within the second fuel tank 112. In an embodiment, the breather tube 146 may be configured to equalize fluid pressure within the tank with an atmospheric pressure.

Figure 3:
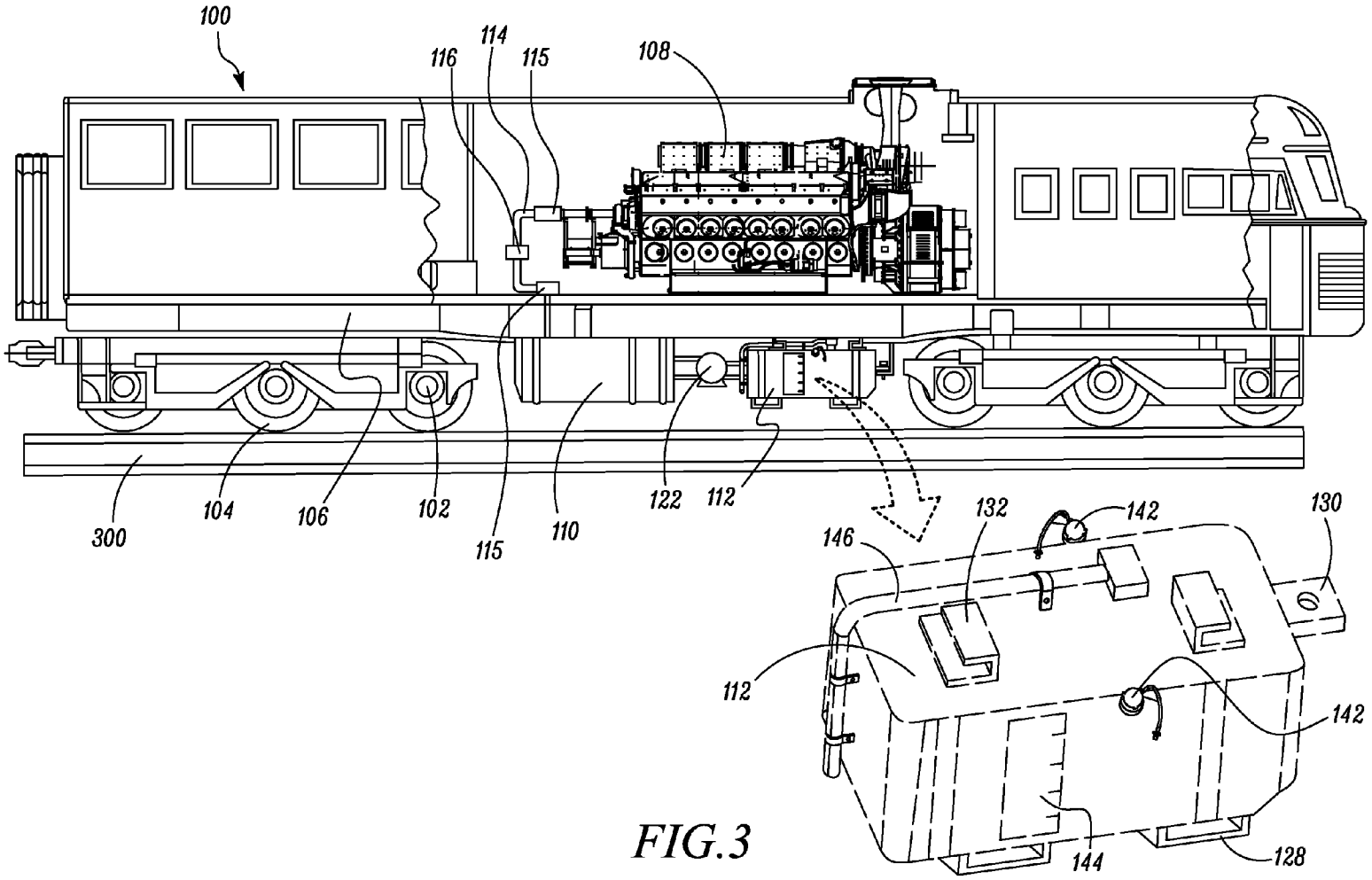
FIGS. 3-4 illustrate a side view of the locomotive system and a railroad in accordance with various embodiments of the present disclosure.
Figure 4:
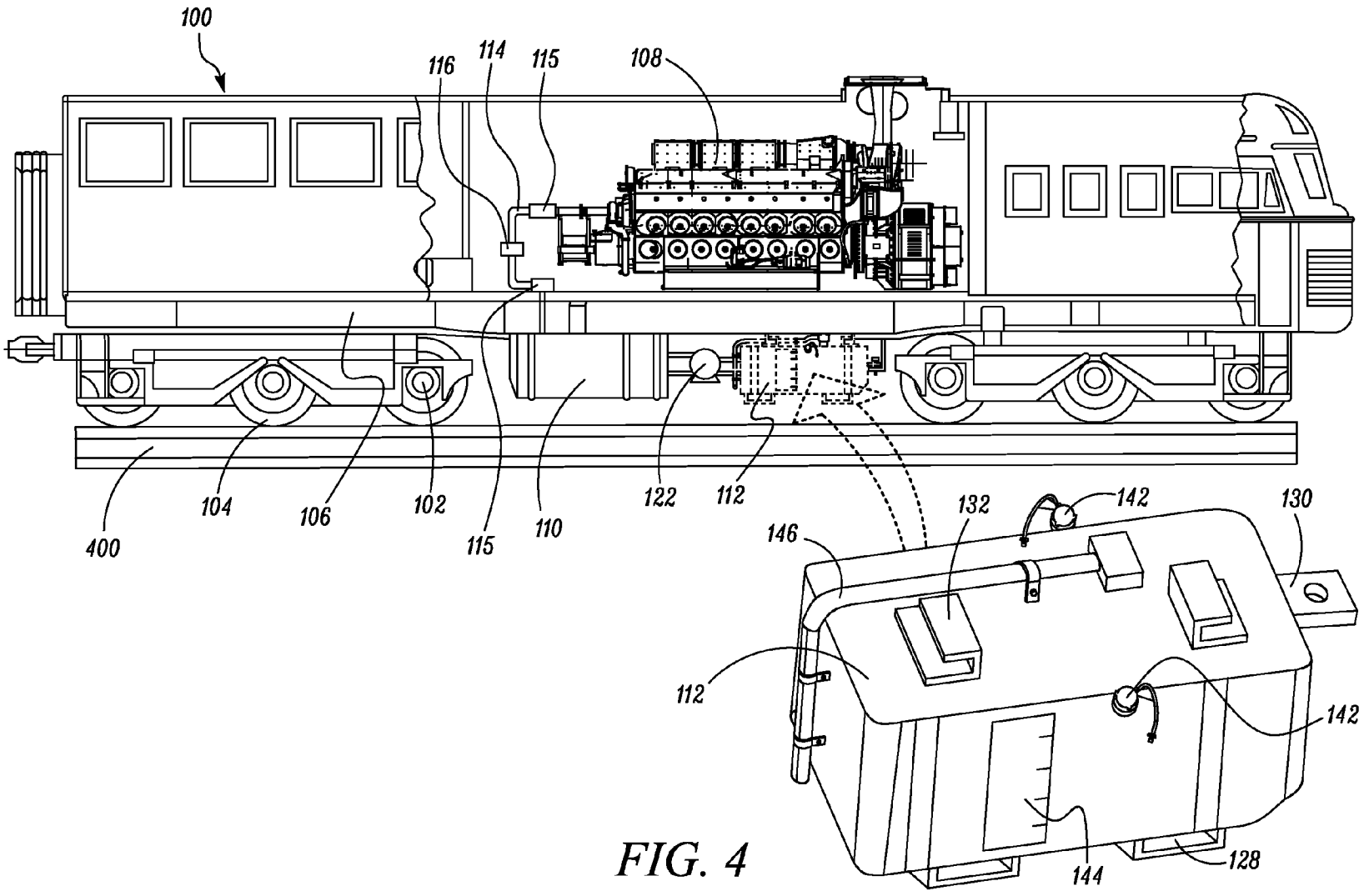

For the purposes of understanding the various embodiments of the present disclosure, a railroad 300 of heavy axle load capacity is shown in FIG. 3, and a railroad 400 of light axle load capacity is shown in FIG. 4 respectively. In one embodiment, the locomotive system 100 may move from the railroad 300 of heavy axle load capacity to the railroad 400 of light axle load capacity. In another embodiment, the locomotive system 100 may move from the railroad 400 of light axle load capacity to the railroad 300 of heavy axle load capacity. Subsequent monitoring of the axle loads when the locomotive system 100 moves from the railroad 300 to the railroad 400 and vice-versa will be explained in the appended disclosure. Further, vertically downward arrows shown in FIGS. 3-4 may be construed to represent the axle loads and the overall weight of the locomotive system 100 while vertically upward arrows may indicate the axle load capacities of the railroads 300, 400. Furthermore, horizontal arrow heads may be construed to represent a direction of fuel transfer between the first fuel tank 110 and the second fuel tank 112.

In an embodiment as shown in FIG. 3, the locomotive system 100 may be running on the railroad 300 of heavy axle load capacity prior to moving onto the railroad 400 of lighter axle load capacity of FIG. 4. In an embodiment, the second fuel tank 112 may be configured to be selectively coupled to the chassis 106 based on an anticipated change in the axle load capacity from railroad 300 to railroad 400.

In an embodiment as shown in FIG. 3, the second fuel tank 112 may be configured to be decoupled from the chassis 106 based on an anticipated decrease in the axle load capacity from railroad 300 to railroad 400. In this embodiment, the second fuel tank 112 may be decoupled with any residual or remnant fuel left behind in the second fuel tank 112. In another embodiment as shown in FIG. 3, the second fuel tank 112 may be configured to receive fuel from the first fuel tank 110 and be decoupled from the chassis 106 based on the anticipated decrease in the axle load capacity from railroad 300 to railroad 400. Therefore, in an embodiment, the pump 122 may be configured to selectively transfer fuel from the first fuel tank 110 to the second fuel tank 112 (as shown by dotted lines with arrows). With reference to the preceding embodiments, decoupling of the second fuel tank 112, with remnant fuel or with fuel transferred from the first fuel tank 110, may decrease the overall weight of the locomotive system 100 thereby decreasing the axle load on each axle 102.

In another embodiment as shown in FIG. 4, the locomotive system 100 may run on the railroad 400 of light axle load capacity before moving onto the railroad 300 of heavy axle load capacity of FIG. 3. In this embodiment, the second fuel tank 112 may be configured to be coupled to the chassis 106 based on an anticipated increase in the axle load capacity from railroad 400 to railroad 300. In one embodiment, the second fuel tank 112 may be configured to transfer fuel to the first fuel tank 110 based on the anticipated increase in the axle load capacity from railroad 400 to railroad 300. In this embodiment, the pump 122 may be configured to selectively transfer fuel from the second fuel tank 112 to the first fuel tank 110 (as shown by dotted lines with arrows). In another embodiment, the second fuel tank 112 may be configured to be refilled based on the anticipated increase in the axle load capacity from railroad 400 to railroad 300. With specific reference to the preceding embodiment, a person having ordinary skill in the art may acknowledge that the refilling of the second fuel tank 112 may be accomplished after or before the second fuel tank 112 is coupled to the chassis 106. However, the refilling of fuel and the transferring of fuel from the second fuel tank 112 to the first fuel tank 110 may be accomplished in any sequence subject to coupling of the second fuel tank 112 to the chassis 106. Therefore, coupling of the second fuel tank 112 with fuel to the chassis 106 may increase the overall weight of the locomotive system 100 thereby increasing the axle load on each axle 102.

As evident from the disclosure pertaining to FIGS. 3-4, the first fuel tank 110 may have a first laden weight while the second fuel tank 112 may have a second laden weight. With specific reference to the locomotive system 100 shown in FIG. 3, the axle load may be proportional to the sum of the first laden weight and the second laden weight. However, with reference to the locomotive system 100 shown in FIG. 4, the axle load may be proportional to the first laden weight alone.

In an embodiment, the axle load capacity of the railroad 300/400 may be defined by a range from a maximum axle load capacity to a minimum axle load capacity. Therefore, in various embodiments disclosed herein, the first laden weight and the second laden weight may be implemented such that the axle load of the locomotive system 100 may lie between the maximum and minimum axle load capacity of the railroad 300/400.

Further, in the preceding embodiment, the second laden weight of the second fuel tank 112 may be affected based on an extent of refueling performed on the second fuel tank 112. Therefore, a person having ordinary skill in the art may acknowledge that the extent of refueling of the second fuel tank 112 may be chosen such that the axle loads of the locomotive system 100 lies between the increased maximum and minimum axle load capacity of the railroad 400 of FIG. 4.

However, in the embodiment of FIG. 4 wherein the second fuel tank 112 may be decoupled from the chassis 106, the second laden weight may be absent and hence omitted from the computation of the axle load. Therefore a person having ordinary skill in the art may acknowledge that in the preceding embodiment, the first laden weight may alone account for the axle load imposed on each axle 102 of the locomotive system 100 and the first laden weight or axle load may lie between the maximum and minimum axle load capacity of the railroad 300 of FIG. 3.

INDUSTRIAL APPLICABILITY

Figure 5:
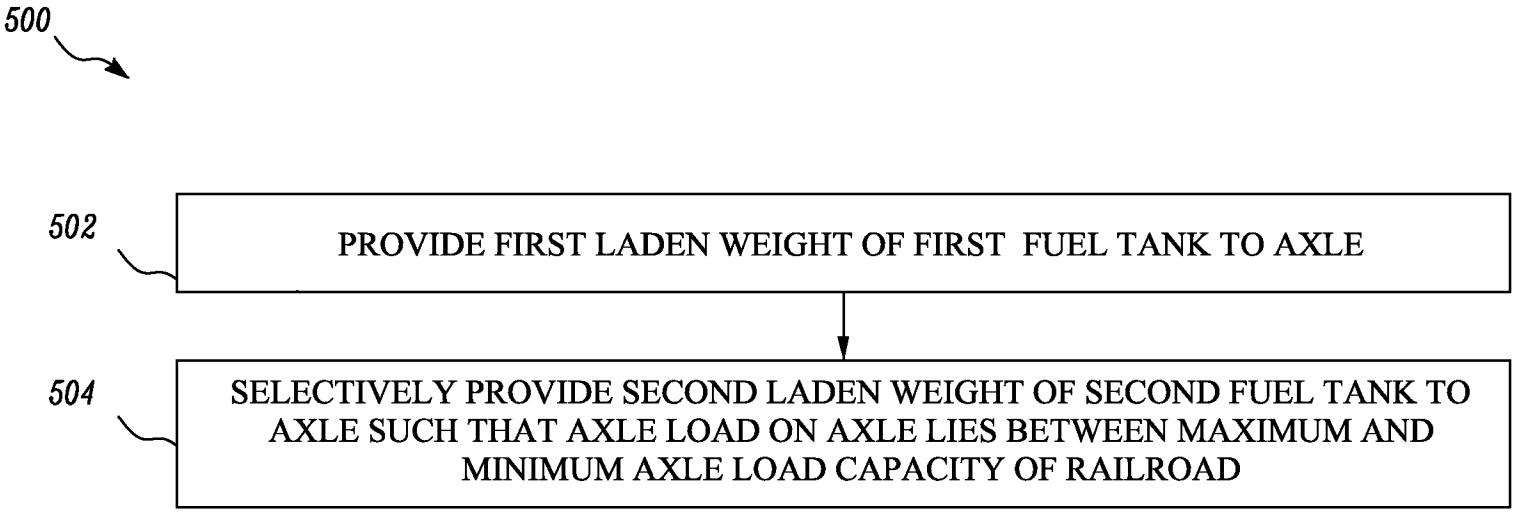
FIG. 5 shows a method of monitoring an axle load of the locomotive.

FIG. 5 shows a method of regulating the axle load on each axle 102 of the locomotive system 100. At step 502, the method includes providing the first laden weight of the first fuel tank 110 to the axle 102. At step 504, the method includes selectively providing the second laden weight of the second fuel tank 112 to the axle 102 such that the axle load on the axle 102 lies between the maximum and minimum axle load capacity of the railroad 300/400.

In an embodiment, selectively providing the second laden weight may be based on an anticipated change in the maximum and minimum axle load capacity from railroad 300/400 to railroad 400/300. In one embodiment, providing the second laden weight may include decoupling the second fuel tank 112 based on the anticipated decrease in the maximum and minimum axle load capacity from railroad 300 to railroad 400. In another embodiment, selectively providing the second laden weight may include coupling the second fuel tank 112 based on the anticipated increase in the maximum and minimum axle load capacity from railroad 400 to railroad 300.

In one embodiment, the method may further include transferring fuel from the first fuel tank 110 to the second fuel tank 112 based on an anticipated decrease in the maximum and minimum axle load capacity from railroad 300 to railroad 400. In another embodiment, the method may further include transferring fuel from the second fuel tank 112 to the first fuel tank 110 based on an anticipated increase in the maximum and minimum axle load capacity from railroad 400 to railroad 300.

In an embodiment, the method may further include refilling the second fuel tank 112 based on the anticipated increase in the maximum and minimum axle load capacity from railroad 400 to railroad 300. As disclosed earlier, the extent of refueling of the second fuel tank 112 may be varied such that the axle load on each axle 102 lies between the increased maximum and minimum axle load capacity of the railroad 300.

Axle load capacities of railroads vary from one railroad to another. A first railroad may be able to withstand a heavy axle load of a locomotive while a second railroad may be able to withstand a lighter axle load as compared to the first railroad. However, each axle of a locomotive may need to confirm to the axle load capacity requirements of the railroad at all instants of time.

Typically, industrial locomotives used to pull cargo containers may comply with different axle load capacities of one or more railroads by involving a transfer of contents from larger cargo containers to smaller containers or vice-versa such that the axle loads associated with the containers comply with the anticipated axle load capacity of the onward railroad. However, the axle load on each axle of the locomotive may still remain unchanged and hence be non-compliant with the axle load capacity of the railroad.

The axle loads of the locomotive may also manifest themselves as an adhesive force between wheels of the locomotive and the railroad. When individual axle loads of the locomotive are lesser than the minimum axle load capacity of the railroad, insufficient adhesion may be present between the wheels and the railroad. Consequently, the wheels associated with the respective axles may slip on the railroad while the locomotive may use excess fuel to overcome the slip. Conversely, when individual axle loads of the locomotive exceed the maximum axle load capacity of the railroad, the railroad may be subject to premature failure.

In the locomotive system 100 of the present disclosure, the axle loads may be varied by selectively coupling the second fuel tank 112 to the chassis 106. A flexibility to vary the axle loads may make the axles 102 of the locomotive system 100 confirm to the anticipated axle load capacity of the onward railroad.

A finer degree of control may further be achieved while varying the axle loads by choosing an extent of refueling the second fuel tank 112 or choosing an amount of fuel to be transferred from the first fuel tank 110 to the second fuel tank 112. The finer degree of control may be helpful in specific embodiments where the axle load capacity of the railroad may be defined by the maximum and minimum axle load capacity respectively.

In various embodiments disclosed herein, coupling, decoupling, or refueling of the second fuel tank 112 may be performed by an operator at a station or a suitable yard. Further, exchanging fuel between the first and the second fuel tanks 110, 112 may be accomplished at the stations/yards or may even be accomplished when the locomotive system 100 is in operation. Thus, the locomotive system 100 disclosed herein may be easy to use, and therefore, may help an operator to conveniently vary the axle loads of a locomotive system 100 while the axle load capacity of the railroad changes.

While aspects of the present disclosure have been particularly shown and described with reference to the embodiments above, it will be understood by those skilled in the art that various additional embodiments may be contemplated by the modification of the disclosed machine, systems and methods without departing from the spirit and scope of what is disclosed. Such embodiments should be understood to fall within the scope of the present disclosure as determined based upon the claims and any equivalents thereof.

I claim:

1. A fuel tank configured to be selectively coupled to a chassis of a locomotive based on an anticipated change in axle load capacity of a railroad, the fuel tank including:

a body;

a coupling device configured to releasably couple the body to the chassis;

a lifting adapter configured to releasably engage with a lifting implement of a machine;

a fill port disposed on the body;

a fuel level indicator configured to indicate a fill level of the fuel; and a breather tube configured to allow equalization of fluid pressure within the fuel tank, wherein the fuel tank is configured to be selectively coupled to the chassis of the locomotive such that an axle load of the locomotive lies between a maximum and minimum axle load capacity of the railroad, and the fuel tank is a second fuel tank in relation to a first fuel tank associated with the locomotive.

2. The fuel tank of claim 1, wherein the second fuel tank is configured to be decoupled from the chassis based on an anticipated decrease in the axle load capacity of the railroad.

3. The fuel tank of claim 1, wherein the second fuel tank is configured to be coupled to the chassis based on an anticipated increase in the axle load capacity of the railroad.

4. The fuel tank of claim 1, wherein the second fuel tank is configured to be refilled based on an anticipated increase in the axle load capacity of the railroad.

5. A fuel tank configured to be selectively coupled to a chassis of a locomotive based on an anticipated change in axle load capacity of a railroad, the fuel tank including:

a body;

a coupling device configured to releasably couple the body to the chassis; and a lifting adapter configured to releasably engage with a lifting implement of a machine; and wherein the fuel tank is a second fuel tank in relation to a first fuel tank associated with the locomotive; and wherein the second fuel tank is configured to receive fuel from the first fuel tank and be decoupled from the chassis based on an anticipated decrease in the axle load capacity of the railroad; or is configured to transfer fuel to the first fuel tank based on an anticipated increase in the axle load capacity of the railroad.

6. A locomotive system configured to run on a railroad, the locomotive system including:

two or more axles;

a chassis disposed on the axles;

an engine connected to the chassis;

a first fuel tank configured to supply fuel to the engine;

a second fuel tank configured to be selectively coupled to the chassis and selectively exchange fuel with the first fuel tank; and a transfer system including a supply line and a return line operatively connected to the first fuel tank and the second fuel tank; and a pump configured to selectively transfer fuel from one of the second fuel tank to the first fuel tank and the first fuel tank to the second fuel tank via the supply line and the return line respectively.

7. The locomotive system of claim 6, wherein the second fuel tank is configured to be selectively coupled to the chassis based on an anticipated change in axle load capacity of the railroad.

8. The locomotive system of claim 7, wherein the second fuel tank is configured to be decoupled from the chassis based on an anticipated decrease in the axle load capacity of the railroad.

9. The locomotive system of claim 7, wherein the second fuel tank is configured to receive fuel from the first fuel tank and be decoupled from the chassis based on an anticipated decrease in the axle load capacity of the railroad.

10. The locomotive system of claim 7, wherein the second fuel tank is configured to be coupled to the chassis based on an anticipated increase in the axle load capacity of the railroad.

11. The locomotive system of claim 7, wherein the second fuel tank is configured to be refilled based on an anticipated increase in the axle load capacity of the railroad.

12. The locomotive system of claim 7, wherein the second fuel tank is configured to transfer fuel to the first fuel tank based on an anticipated increase in the axle load capacity of the railroad.

13. The locomotive system of claim 6, wherein the second fuel tank includes:

a body;

a coupling device configured to releasably couple the body to the chassis; and a lifting adapter configured to releasably engage with a lifting implement of a machine.

14. The locomotive system of claim 13, wherein the second fuel tank further includes:

a fill port disposed on the body;

a fuel level indicator configured to indicate a fill level of the fuel; and a breather tube configured to allow equalization of fluid pressure within the second fuel tank.

15. A locomotive system configured to run on a railroad, the locomotive system including:

two or more axles;

a chassis disposed on the axles;

an engine connected to the chassis;

a first fuel tank configured to supply fuel to the engine, the first fuel tank having a first laden weight imposed on the axles;

a second fuel tank configured to be selectively coupled to the chassis and selectively exchange fuel with the first fuel tank, the second fuel tank having a second laden weight imposed on the axles such that an axle load on each of the axles lies between a maximum and minimum axle load capacity of the railroad.

16. The locomotive system of claim 15, wherein the second fuel tank is configured to be selectively coupled to the chassis based on an anticipated change in the maximum and minimum axle load capacity of the railroad.

17. The locomotive system of claim 16, wherein the second fuel tank is configured to receive fuel from the first fuel tank and be decoupled from the chassis based on an anticipated decrease in the maximum and minimum axle load capacity of the railroad.

18. The method of claim 17 further including refilling the second fuel tank based on an anticipated increase in the maximum and minimum axle load capacity.

19. The method of claim 17 further including transferring fuel from the second fuel tank to the first fuel tank based on an anticipated increase in the maximum and minimum axle load capacity.

20. The locomotive system of claim 16, wherein the second fuel tank is configured to be decoupled from the chassis based on an anticipated decrease in the maximum and minimum axle load capacity of the railroad.

21. The locomotive system of claim 16, wherein the second fuel tank is configured to be coupled to the chassis based on an anticipated increase in the maximum and minimum axle load capacity of the railroad.

22. The locomotive system of claim 16, wherein the second fuel tank is configured to be refilled based on an anticipated increase in the maximum and minimum axle load capacity of the railroad.

23. The locomotive system of claim 16, wherein the second fuel tank is configured to transfer fuel to the first fuel tank based on an anticipated increase in the maximum and minimum axle load capacity of the railroad.

24. The locomotive system of claim 15 further including a transfer system including:

a supply line and a return line operatively connected to the first fuel tank and the second fuel tank; and a pump configured to selectively transfer fuel from one of the second fuel tank to the first fuel tank and the first fuel tank to the second fuel tank via the supply line and the return line respectively.

25. The locomotive system of claim 15, wherein the second fuel tank includes:

a body;

a coupling device to releasably couple the body to the chassis; and a lifting adapter configured to releasably engage with a lifting implement of a machine.

26. The locomotive system of claim 25, wherein the second fuel tank further includes:

a fill port disposed on the body;

a fuel level indicator configured to indicate a fill level of the fuel; and a breather tube configured to allow equalization of fluid pressure within the second fuel tank.

* * * * *